US011072518B2

(12) United States Patent
Volohovs

(10) Patent No.: US 11,072,518 B2
(45) Date of Patent: Jul. 27, 2021

(54) WINCH

(71) Applicant: Dmitrijs Volohovs, Riga (LV)

(72) Inventor: Dmitrijs Volohovs, Riga (LV)

( * ) Notice: Subject to any disclaimer, the term of this patent is extended or adjusted under 35 U.S.C. 154(b) by 335 days.

(21) Appl. No.: 16/211,645

(22) Filed: Dec. 6, 2018

(65) Prior Publication Data

US 2020/0180920 A1 Jun. 11, 2020

(51) Int. Cl.
*B66D 1/56* (2006.01)
*B66D 1/48* (2006.01)

(52) U.S. Cl.
CPC ..... *B66D 1/56* (2013.01)

(58) Field of Classification Search
CPC ... B66D 1/48; B66D 1/54; B66D 1/56; B66D 1/485; B66D 1/50; B66D 1/505; B66D 1/52; B66D 3/18; B66D 3/24; F21V 21/16; F21V 21/38
See application file for complete search history.

(56) References Cited

U.S. PATENT DOCUMENTS 1,848,972 A * 3/1932 Peebles ..... B66D 1/48 254/273
2,637,525 A 5/1953 Lock
3,608,864 A * 9/1971 Dargitz ..... B66D 1/48 254/274
4,042,213 A 8/1977 Schreyer et al.
4,928,925 A * 5/1990 Christison ..... B63B 23/50 254/264
6,520,484 B1 * 2/2003 Shimizu ..... B66D 1/50 254/276
7,153,001 B2 * 12/2006 Kim ..... F21V 21/38 362/291
8,348,215 B1 * 1/2013 Smith ..... F04D 29/601 248/329
9,815,670 B2 * 11/2017 Bauder ..... F21V 27/00
2005/0179020 A1 * 8/2005 Taylor ..... B66D 1/485 254/270
2007/0290180 A1 * 12/2007 Kazerooni ..... B66D 3/18 254/275
2010/0227499 A1 * 9/2010 Ramos ..... F21V 21/38 439/537
2014/0091268 A1 * 4/2014 Heravi ..... B66D 1/505 254/274

(Continued)

FOREIGN PATENT DOCUMENTS

DE 30 48 262 A1 7/1982
EP 3115687 A1 1/2017

(Continued)

OTHER PUBLICATIONS

EP Office Action in co-pending application EP 20185533, dated Oct. 16, 2020.

(Continued)

*Primary Examiner* — Michael E Gallion
(74) *Attorney, Agent, or Firm* — Robert R. Deleault, Esq.; Mesmer & Deleault, PLLC

(57) ABSTRACT

A winch comprising one or more of an overwinding prevention unit, a load spin prevention device, a power supply board comprising substantially circular electrical contacts, a rope tension control unit, and a system comprising the winch and a load, attached to the winch, having a load battery chargeable via the winch.

14 Claims, 16 Drawing Sheets

(56) References Cited

U.S. PATENT DOCUMENTS

| | | | | |
|---|---|---|---|---|
| 2019/0270625 | A1* | 9/2019 | Volohovs | B66D 3/24 |
| 2020/0207594 | A1* | 7/2020 | Hubener | B66D 3/06 |
| 2020/0239287 | A1* | 7/2020 | Volohovs | B66D 1/56 |

FOREIGN PATENT DOCUMENTS

| | | | |
|---|---|---|---|
| JP | 08-192995 | A | 7/1996 |
| WO | 02055931 | A1 | 7/2002 |

OTHER PUBLICATIONS

European search report for EPO 17188834.0 co-pending application, dated May 25, 2018.

* cited by examiner

200

200

500

WINCH

BACKGROUND OF THE INVENTION

1. Field of the Invention

The present invention relates generally to a winch comprising one or more of an overwinding prevention unit, a load spin prevention device, a power supply board comprising substantially circular electrical contacts, a rope tension control unit, and a system comprising a said winch and a load, attached to the winch, having a load battery chargeable via the winch.

2. Description of the Prior Art

A winch apparatus is described, for example, in JP 2007-284174 A. The winch is used for winding and unwinding a cable. In this disclosure, a cylindrical and transparent casing for permeating light is built-in in a secondary cable guide supported on a cable guide arm. A light emitting diode for irradiating the secondary cable with light and a photo-diode for receiving the reflected light are provided on an outer periphery of the transparent casing. A black marker for absorbing the light is stuck onto the outer periphery of the secondary cable with a constant clearance in a longitudinal direction of the cable. A signal processing device is provided for detecting, by the photo-diode, that the reflected light from the secondary cable is interrupted by the marker when the secondary cable is passed through the secondary cable guide and calculating an operation amount, by the winch, of the secondary cable based on intervals of the marker detected.

Further prior art can be found in, for example, U.S. Pat. No. 7,153,001 B2, which describes an auto lift ceiling lighting system in which the width of the left and right rotary drums is formed as wide as the width of the flat cable and the flat cable is winded stably and vertically on the outer surface of the winding core in the left and right rotary drums when winded by the motor, thereby not to be twisted. In the auto lift ceiling lighting system, the lamp can be turned on and off at any position and the flat cable supplying the electric power to the lamp is not twisted and the balance of the lamp is kept while the lamp ascends and descends.

However, there is a need for further improvements of winches

SUMMARY OF THE INVENTION

Winches according to the present invention are set out in the independent claims. Preferred embodiments of the winches are outlined in the dependent claims.

The present invention provides a winch which comprises an overwinding prevention (OP) unit. The OP unit includes an OP trigger for triggering preventing a load from being raised further by the winch, and an OP trigger activator (OPTA) moveable between a first OPTA position and a second OPTA position relative to the OP trigger where the OP trigger is in a deactivated state when the OPTA is in the first OPTA position, and where the OP trigger is in an activated state, to trigger preventing the load from being raised further by the winch, when the OPTA is in the second OPTA position; and where the OPTA is contactable by the load such that the OPTA is moveable from the first OPTA position to the second OPTA position upon the load being raised by the winch.

In some example implementations, once the load is being raised by the winch, the load (that is an object attached to the winch allowing for the object to be raised and/or lowered) may eventually contact the OPTA. When the load is being raised further, the OPTA may be pushed via the load from the first OPTA position to the second OPTA position. The load pushing the OPTA into the second OPTA position may therefore result in the OP trigger being set to the activated state. This may allow for preventing the winch from raising the load further, thereby preventing an overwinding which may otherwise, for example, result in the rope of the winch breaking.

In some example implementations, the OP trigger may be a switch which is switchable by the OPTA when being moved from the first OPTA position to the second OPTA position. Additionally or alternatively, the OP trigger may be part of an electric circuit where the electric circuit may be closed upon the OPTA being in contact with the OP trigger. Alternative implementations of the OP trigger will be readily known to those skilled in the art.

The OPTA may, in some variants, include a pin which may be used to activate the OP trigger when the OPTA is moved from the first OPTA position to the second OPTA position. The pin may hereby be brought into direct contact with the load which is to be raised by the winch. Alternatively, the pin may be coupled to a first body of the OPTA where the first body may, for example, provide for a larger surface which is contactable by the load to be raised by the winch. In this example implementation, the pin will be moved based on the load pushing the first body of the OPTA, such that the OP trigger may be activated when the OPTA has reached the second OPTA position.

In a further example implementation of the winch, the OP unit further includes one or more resilient members (i.e. resilient OP unit members) configured to bias the OPTA towards the first OPTA position. In some variants, the one or more resilient members comprise one or more compression springs. The one or more resilient members may hereby allow for the OP unit, and, in particular, the OPTA of the OP unit to be in tight contact with the load at least in some positions of the OPTA. This may further increase stability regarding any alignment between the OP unit and the load, in particular, when the load is being raised or lowered by the winch.

The one or more resilient members may further provide a buffer insofar that the load is not being damaged when raised beyond a certain level.

In a further variant, the winch is configured to automatically lower the load upon activation of the OP trigger. This may be particularly advantageous as this may prevent one or both of the load from otherwise being damaged when raised beyond a certain level and the rope of the winch not experiencing a tension exceeding a certain, predetermined threshold when the winch further aims to wind the rope while the load may not be raised (or raisable) any further. An automatic lowering of the load upon activation of the OP trigger may therefore prevent any damages to the load and/or the rope.

We further describe a winch, particularly as outlined according to one or more of the above-identified implementations, which includes a load spin prevention device which is configured to decouple the load to be raised by the winch from the rope of the winch. In some variants, the load spin prevention device may include one or more ball bearings. These one or more ball bearings may be placed in between a lock unit, which may be used to attach the load, and a support member such that the one or more ball bearings are prevented from sliding off the load spin prevention device. The load spin prevention device, by decoupling the load from the rope, allows for the load being held generally in a certain rotational position while being raised or lowered by the winch irrespective of whether the winding or unwinding of the rope in order to raise or lower the load, respectively, will result in a twisting of the rope.

We further describe a winch, particularly as outlined according to one or more of the above-specified implementations, which includes an annular body which comprises a power supply board, where the power supply board includes substantially circular electrical contacts contactable by a load. This may be particularly advantageous in cases in which the load includes a battery which may be charged via the winch, i.e. via an electric circuit comprised in the winch or coupled to the winch. Furthermore, as outlined above, the rope may twist when being wound or unwound by the winch. Therefore, providing a power supply board which comprises substantially circular electrical contacts may allow for establishing an electrical contact between the winch and the load irrespective of the relative angular position of the load with respect to the winch around an axis defined by the winch, i.e. the direction of the rope. As will be appreciated, even if the winch comprises a load spin prevention device to decouple the load from the rope, the load may still, at least by a small amount, rotate around the above-specified axis when the rope is being wound or unwound. This may be due to a certain friction between the load and the load holder of the winch (irrespective of their decoupling), which may enable transfer of a (potentially minimal) torque from the twisted rope to the load. Providing a power supply board which comprises substantially circular electrical contacts will therefore ensure an electrical contact to electrical contacts of the load also in a variant of the winch in which a load spin prevention device is used.

The power supply board may be integral to the printed circuit board as described throughout the present disclosure.

In further example implementations of the winch, the one or more resilient members are configured to stabilize the annular body upon the load being raised or lowered by the winch. In some variants, one resilient member may be arranged on either side of the annular body. In some other example implementations, two pairs of resilient members are exploited, in which, for each of the pairs, one resilient member is arranged on the annular body in an opposite direction to the second resilient member with respect to the axis defined by the rope of the winch. This may result in a particularly stable configuration.

In some variants, the winch further includes a charging unit configured to charge a battery of the load via the circular electrical contacts. The charging unit may hereby be coupled to the substantially circular electrical contacts via a power supply wire. The charging unit may be controlled by a microcontroller which may be used to determine a charging level of the battery of the load.

We further describe a winch, particularly as outlined according to one or more of the above-specified implementations, which comprises a rope tension control (RTC) unit for determining a tension experienced by a rope of the winch, where the RTC unit includes an RTC trigger for triggering preventing the winch from further winding or unwinding the rope, and an RTC trigger activator (RTCTA) moveable between a first RTCTA position and a second RTCTA position relative to the RTC trigger where the RTC trigger is in a deactivated state when the RTCTA is in the first RTCTA position, and where the RTC trigger is in an activated state, to trigger preventing the winch from further winding or unwinding the rope, when the RTCTA is in the second RTCTA position, and where the RTCTA is configured to move into the second RTCTA position when the tension experienced by the rope falls below a (predefined) threshold tension.

In some examples, the RTC trigger comprises a switch which may be activated by an activation pin of the RTCTA.

Generally, the winch according to some example implementations as described herein may be arranged such that a rope guide wheel is movable between different positions based on the tension experienced by the rope. If the tension experienced by the rope falls below a certain predefined threshold, the RTCTA, which is coupled to the rope guide wheel, moves to the second RTCTA position in order to bring the RTC trigger into the activated state.

Variants of the winch may therefore allow, for example, for preventing the rope from jumping out of a rope drum during transportation of the winch or during any other scenario in which no or little load is attached to the winch and/or the power of the winch is switched off. The rope may hereby be automatically clamped, as will be further described below.

Furthermore, providing a winch with an RTC unit may allow for preventing the winch from starting to run without a load being attached to the winch, thereby preventing the rope from jumping out of the drum.

Providing a winch with an RTC unit may further allow stopping the winch from working (i.e. from, for example, winding or unwinding the rope) once the load touches the ground or another object during movement.

In some example implementations of the winch, the RTC unit further comprises a resilient RTC member configured to bias the RTCTA towards the second RTCTA position. In some variants, the resilient RTC member may be a compression spring. If no load or a load below a certain threshold is experienced by the winch, using the resilient RTC member may allow for activating the RTC trigger in order to, for example, stop the winch from winding or unwinding the rope to prevent the rope from jumping out of the rope drum, amongst other advantages as outlined above.

In some example implementations, the winch further comprises a rope guide wheel for guiding the rope of the winch and a stop member for clamping the rope between the rope guide wheel and the stop member when the RTCTA is in the second RTCTA position. This may be particularly advantageous insofar that the rope may be prevented from jumping out of the rope drum if the tension experienced by the rope falls below a certain predetermined threshold.

In some further variants of the winch, the stop member is movable between different stop member positions, relative to a position of the rope guide wheel, based on a diameter of the rope. This may allow for regulating the gap between the stop member and the rope guide wheel dependent on a diameter (or thickness in the direction away from the rope guide wheel) of the rope.

In some examples, the stop member may be a flat end screw, which may be particularly advantageous as it allows for easy adjustment of the position of the flat end screw relative to a position of the rope guide wheel (for a particular tension experienced by the rope).

In some further example implementations of the winch, the RTC trigger is arranged on a printed circuit board comprised in a support frame for supporting the RTC unit. This may allow for providing a particularly compact configuration of the winch which may be particularly useful for relatively small winches. All control electronics may hereby be located on the printed circuit board, including any triggers and/or switches specified throughout the present disclosure.

In some further variants of the winch, the RTC unit further comprises a rope deterioration detection unit configured to detect a deterioration of the rope based on an electrical contact being established between the stop member and the rope when the RTC trigger is in the deactivated state. This may be particularly advantageous as it may allow, for example, for replacing or repairing the rope if it is in a certain deteriorated state. This may also be advantageous as the load may otherwise fall if the rope were to break.

In some example implementations, the rope deterioration detection unit is further configured to stop the winch from winding or unwinding the rope and/or trigger an alarm upon detection of the electrical contact being established between the stop member and the rope when the RTC trigger is in the deactivated state. The alarm may comprise, for example, blinking of visual indicators, such as LEDs, or sending data to a central controller. In particular, stopping the winch from winding or unwinding the rope further may allow for preventing the rope from breaking, thereby inhibiting the load from falling and being damaged.

We further describe a system comprising the winch according to any one of the above-specified implementations, in which the annular body comprising a power supply board is used, where the winch comprises a load holder, and where the system further includes a load attached to the load holder. The load includes load electrical contacts and a load battery. The system is configured, when the load is in contact with the OP unit, to charge the load battery based on the load electrical contacts being brought into contact with the substantially circular electrical contacts of the power supply board.

These and other aspects of the invention will now be further described, by way of example only, with reference to the accompanying figures, where like reference numerals refer to like parts.

DETAILED DESCRIPTION OF THE INVENTION

Figure 1A:
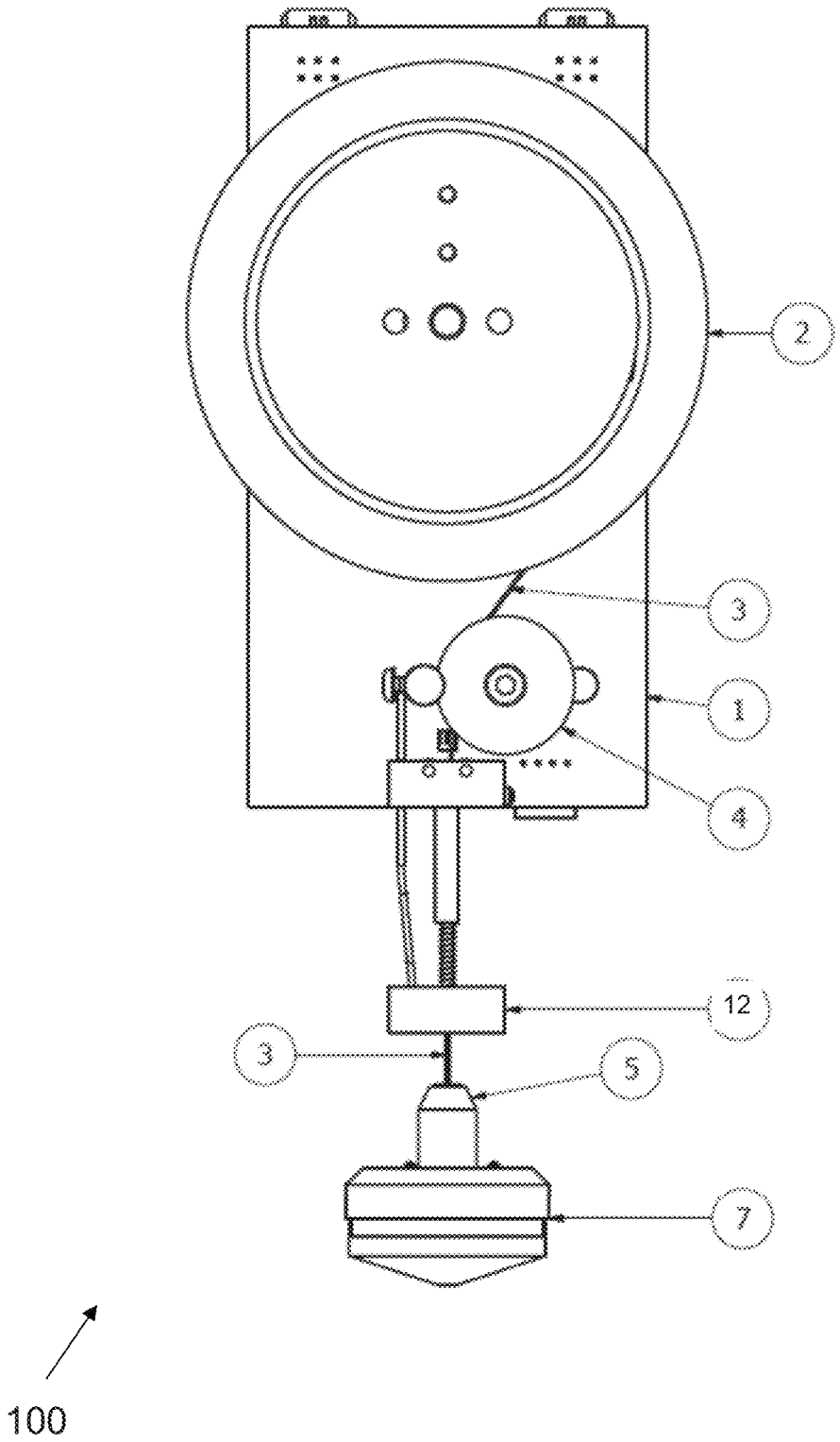
FIGS. 1*a* and 1*b* show, respectively, front and side views of a schematic illustration of a winch according to some example implementations as described herein.

FIG. 1*a* shows a front view of a schematic illustration of a winch 100 according to some example implementations as described herein.

In this example, the winch 100 comprises a support frame 1 and a rope drum 2 mounted on the support frame 1. The rope 3 can be wound or unwound onto the rope drum 2 by the winch 100.

A rope tension controller 4 is mounted, in this example, on the support frame 1.

An object (load) 7 is attached to the winch 100 via a load spin prevention device 5 which is, in this example, integral to a load holder.

An overwinding prevention, OP, unit, which comprises a first body 12, is arranged between the load spin prevention device 5 and the load 7 attached to the winch 100.

Figure 1B:
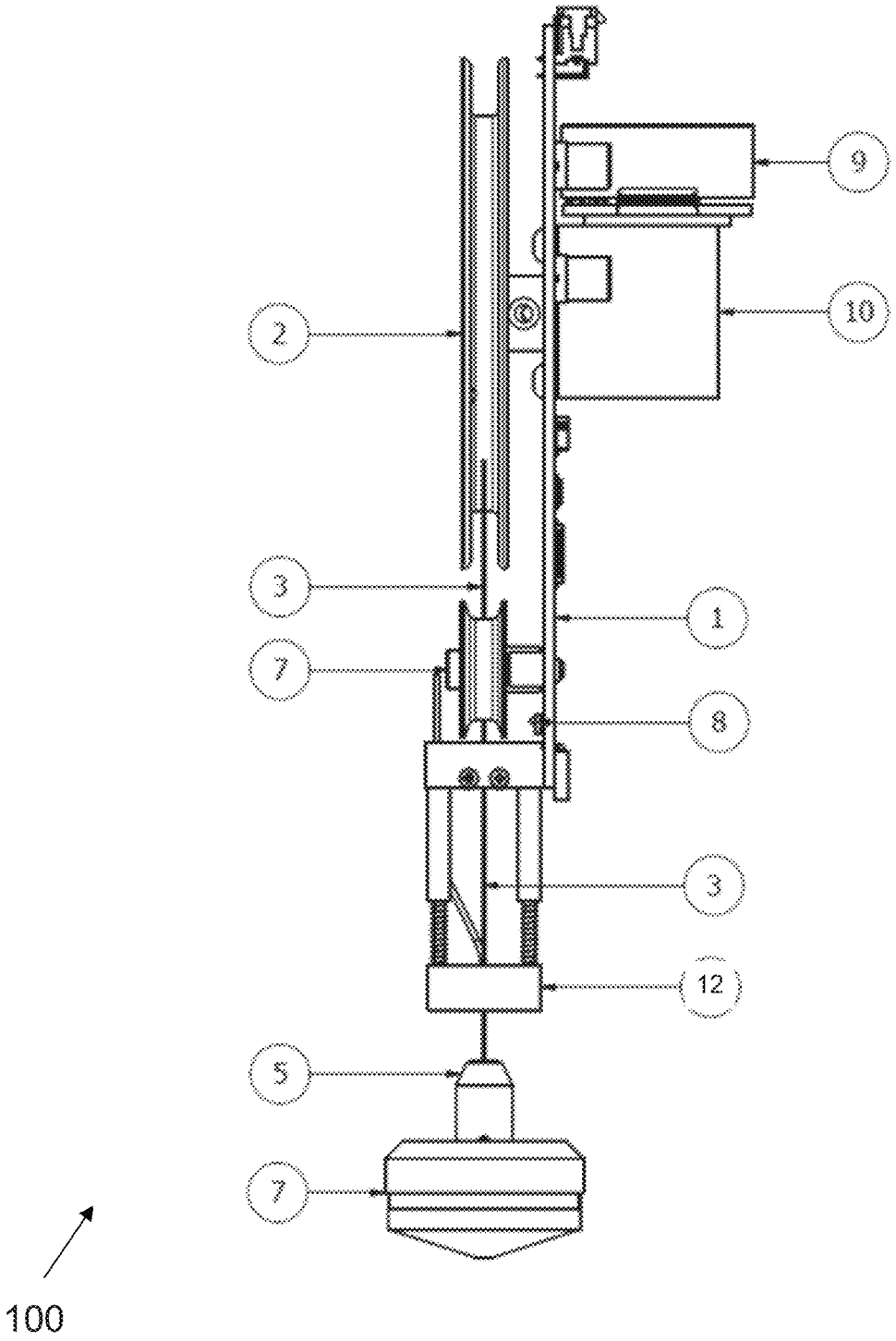

FIG. 1*b* depicts a schematic side view of the winch 100. As can be seen in FIG. 1*b*, the OP unit comprises, in this example, a switch 8 which is used for triggering preventing the load 7 from being raised further by the winch 100.

The winch 100 further comprises a motor 9 and a gearbox 10.

The various features of the winch 100 will now be further described in more detail with reference to the accompanying drawings.

Figure 2A:
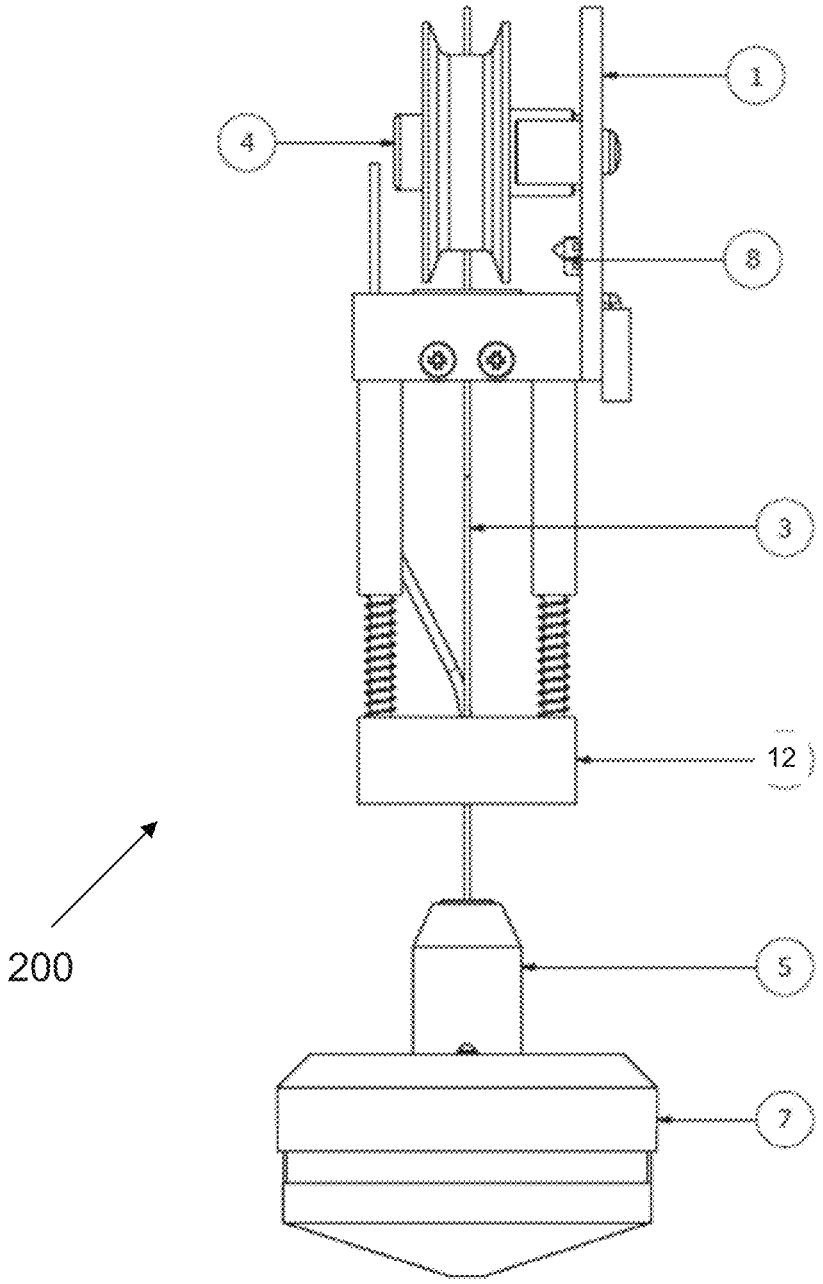
FIGS. 2*a* to 2*c* show schematic illustrations of an OP unit and a load attached to the winch according to some example implementations as described herein.

FIG. 2*a* shows a schematic illustration of an OP unit 200 according to some example implementations as described herein. In this example, the rope 3 passes from the rope drum 2 through the OP unit 200 to the load spin prevention device 5 to which the load (object) 7 is attached. In FIG. 2*a*, the winch is in a stage in which the object 7 is pulled up via the rope 3.

Figure 2B:
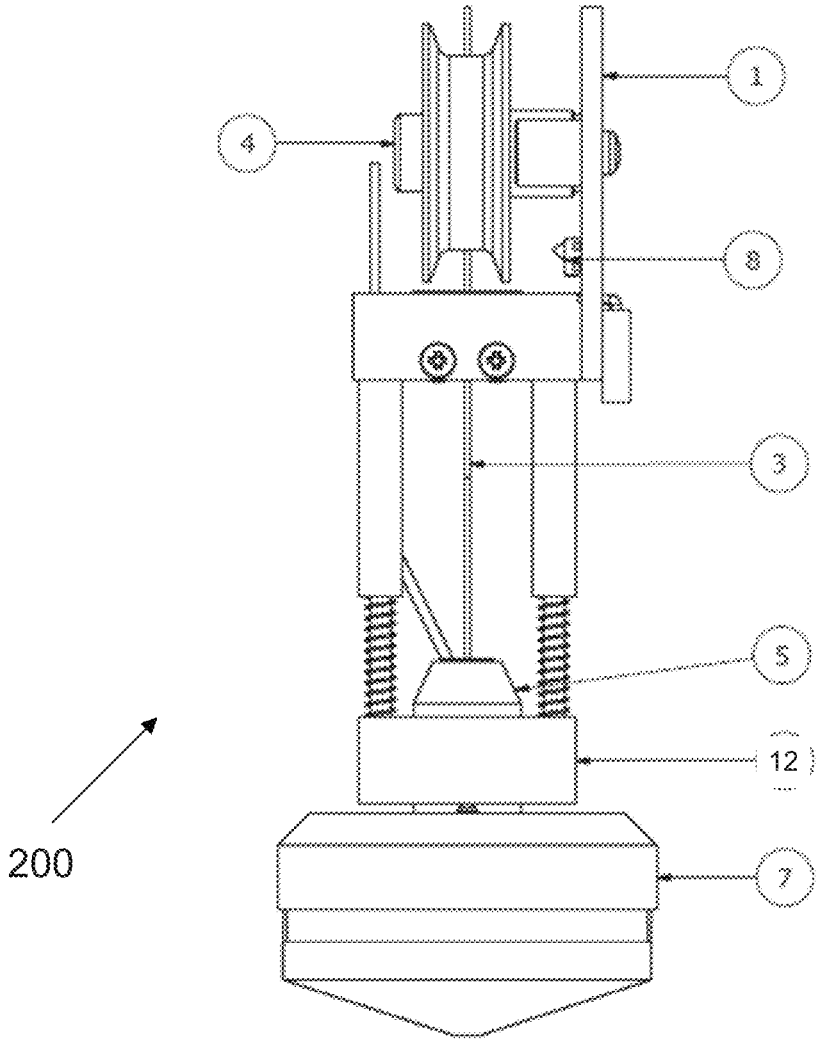

FIG. 2*b* depicts a schematic illustration in which the object 7 is pulled up by the winch via the rope 3 to such an extent that the object 7 touches the first body 12 of the OP unit 200. In this example, the first body 12 of the OP unit 200 comprises an annular body 12, the center of which is penetrable by the load spin prevention device 5.

Figure 2C:
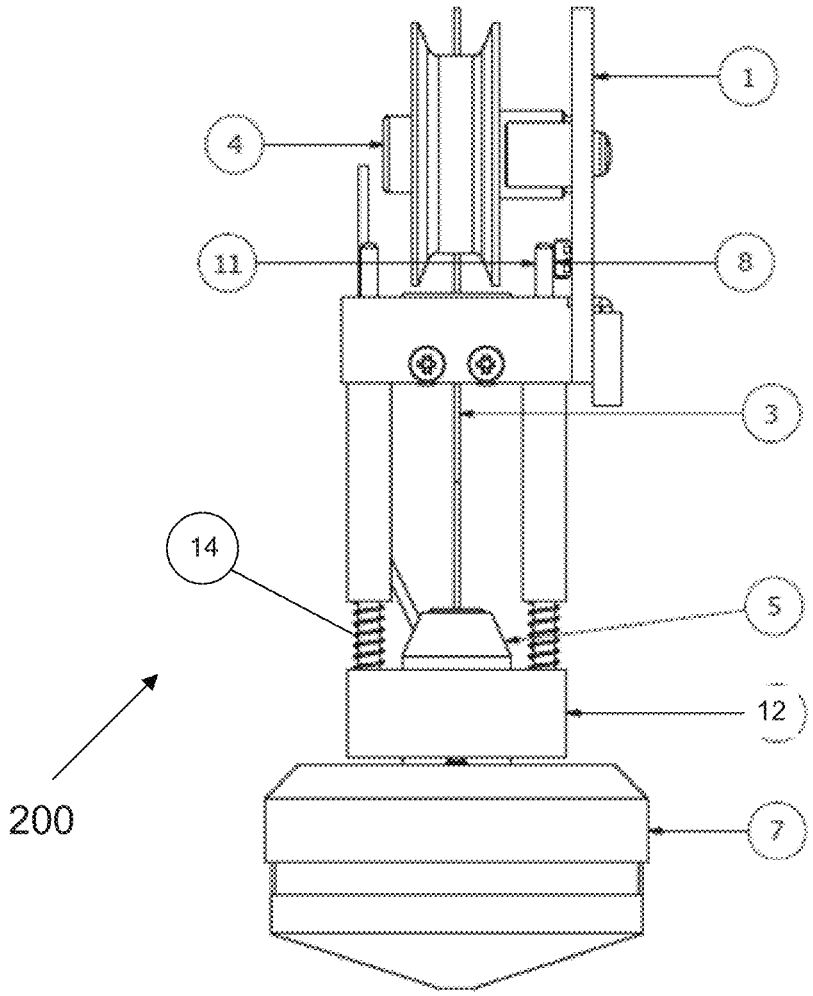

FIG. 2*c* shows a schematic illustration in which the object 7 is raised further by the winch. By raising the object 7 to a position as shown in FIG. 2*c*, activation pins 11 of the OP unit 200 will be pushed, in this example, upwards to such an extent that the switch 8 is being activated.

When the switch 8 is activated, a microcontroller will stop the upward movement, and will trigger a downward movement to release (inactivate) the switch 8.

When the switch 8 is activated, a microcontroller will stop the upward movement, and will trigger a downward movement to release (inactivate) the switch 8.

Compression springs 14 of the OP unit 200 allow for the OP unit 200 to be in tight contact with the object 7.

Figure 3A:
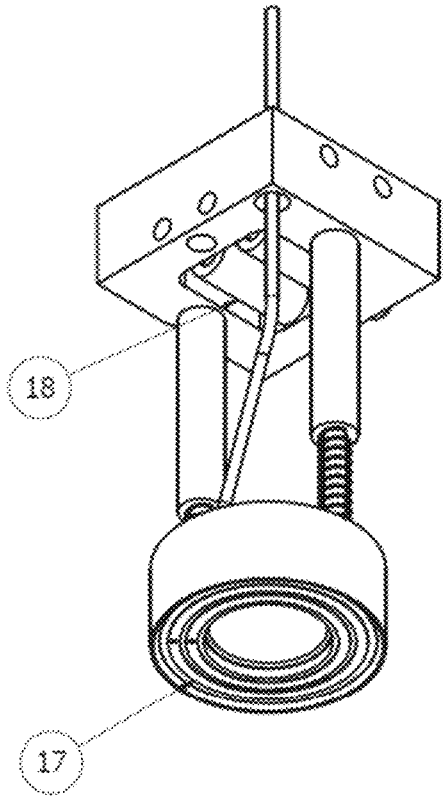
FIGS. 3*a* to 3*c* show further schematic illustrations of an OP unit according to some example implementations as described herein.
Figure 3B:
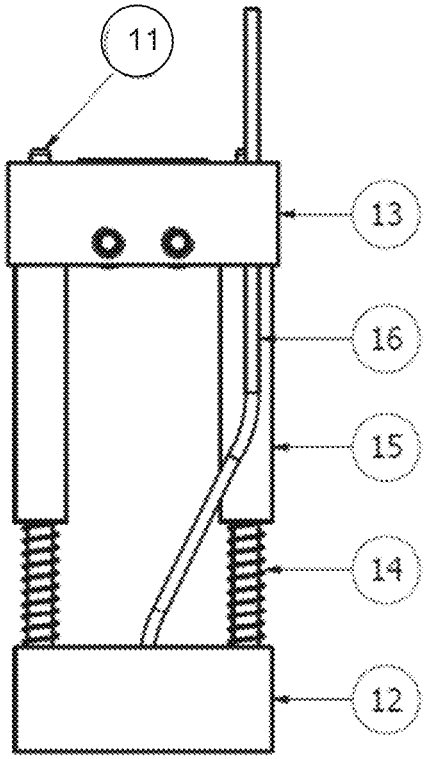

FIGS. 3*a* and 3*b* show, respectively, perspective and side views of a schematic illustration of the OP unit 200 according to example implementations as described herein. As can be seen in FIG. 3*a*, the OP unit 200 comprises, in this example, a rope roller 18. The first body 12 of the OP unit 200 comprises, on one of its surfaces, a power supply board 17. As shown in FIG. 3*b*, the OP unit 200 further comprises, in this example, a second body 13 through which the activation pins 11 can pass.

As outlined above, compression springs 14 are used in order to ensure that the OP unit 200 remains in tight contact with the object 7 for some positions of the OP unit 200 relative to the object 7.

The OP unit 200 further comprises, in this example, linear slides 15 for guiding the activation pins 11. Furthermore, a power supply wire 16 is provided, which allows for charging a battery of an object in contact with the OP unit 200 via the power supply board 17.

Figure 3C:
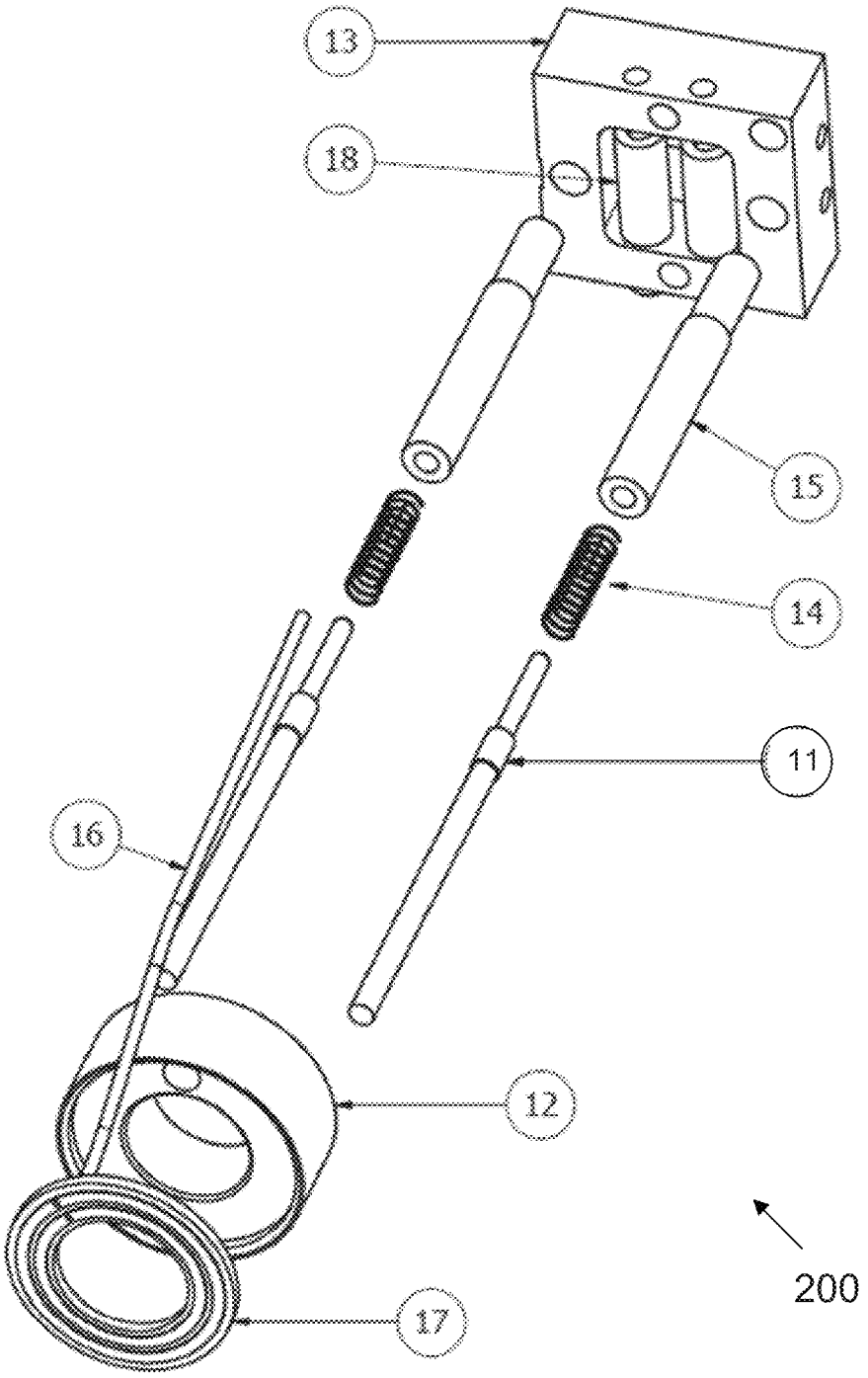

For further clarification, FIG. 3*c* shows a schematic illustration of the OP unit 200 in which various features thereof are disconnected from each other. It is to be noted that the switch 8 may be considered as being part of the OP unit 200 or as a separate feature of the winch which may be activated by the OP unit 200.

Figure 4A:
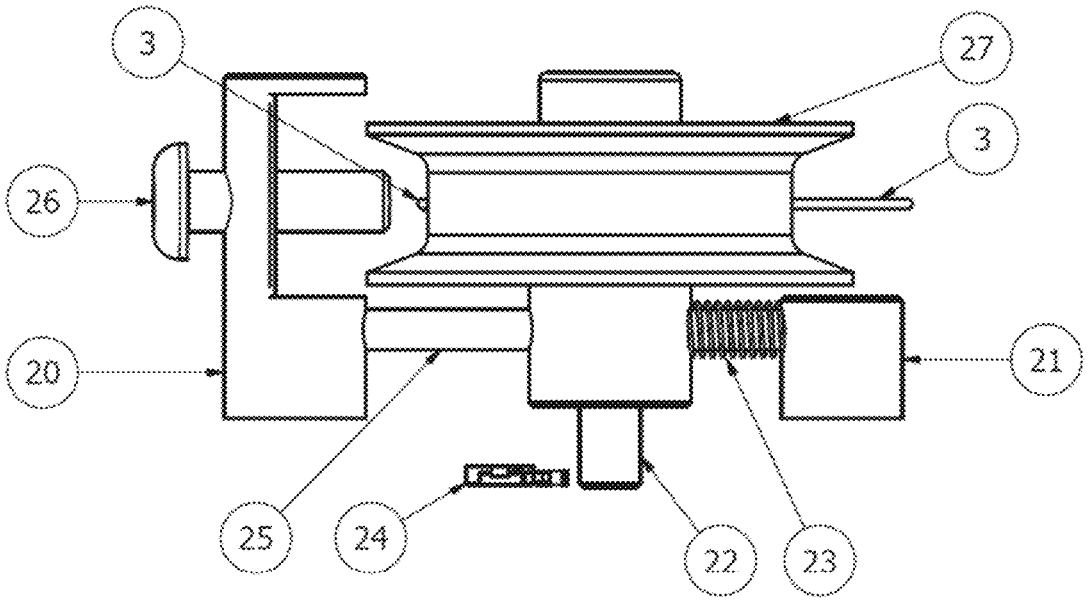
FIGS. 4*a* to 4*h* show schematic illustrations of an RTC unit according to some example implementations as described herein.
Figure 4B:
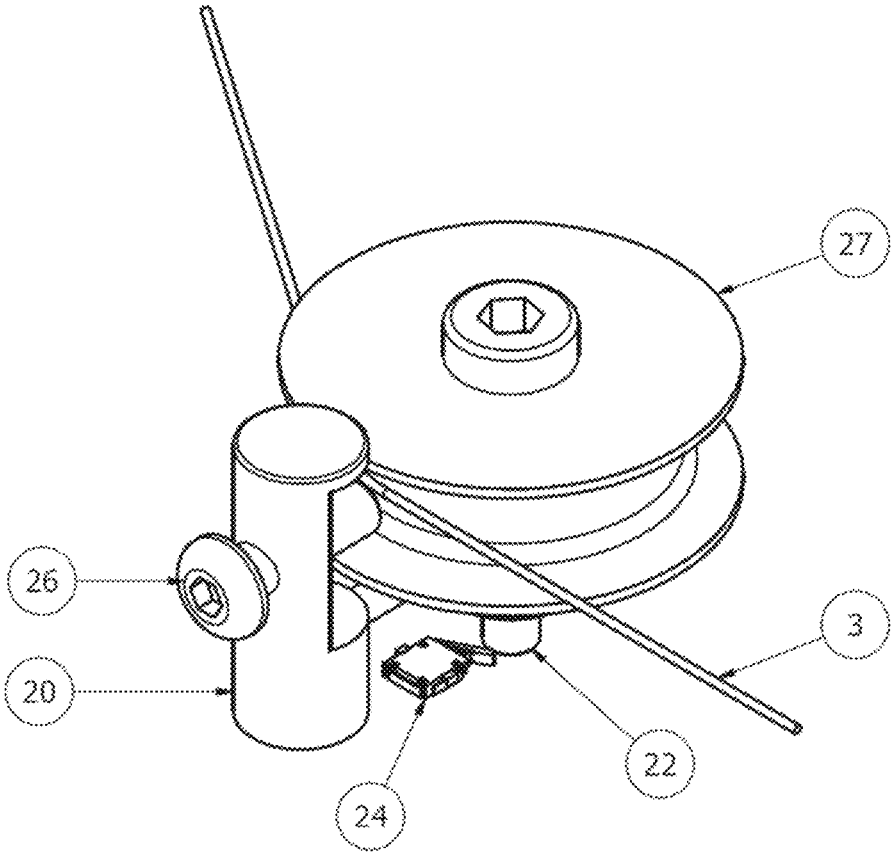

FIGS. 4*a* and 4*b* show, respectively, side and perspective views of a schematic illustration of parts of an RTC unit 400 according to some example implementations as described herein.

In this example, the RTC unit 400 comprises a first support 20 and a second support 21. A switch 24 of the RTC unit 400 is provided which allows, for example, for triggering the winch from trying to wind or unwind the rope 3 further.

In this example, a compression spring 23 is arranged between the second support 21 and a part of the RTC unit 400 which is coupled to the rope guide wheel 27. The compression spring 23 is configured to bias the rope guide wheel 27 towards the first support 20. The switch 24 may be activated via the activation pin 22 of the RTC unit 400.

In this example, the rope guide wheel 27 may be guided towards the first support 20 via an axis 25 of the RTC unit 400. In this example, the RTC unit 400 further comprises a flat end screw 26 which is configured, for example, as a stop member.

FIGS. 4*a* and 4*b* depict a scenario in which the RTC unit 400 is in a deactivated state, i.e. a state in which the rope 3 experiences a certain amount of tension. In the deactivated state of the RTC unit 400, there is a gap between the flat end screw 26 and the rope 3.

Figure 4C:
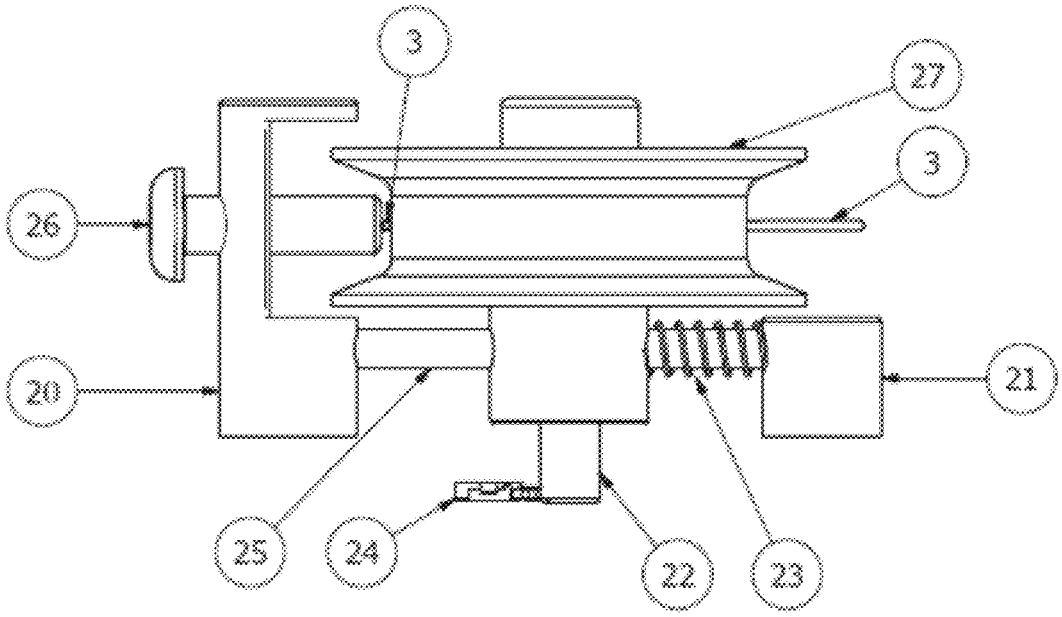
Figure 4D:
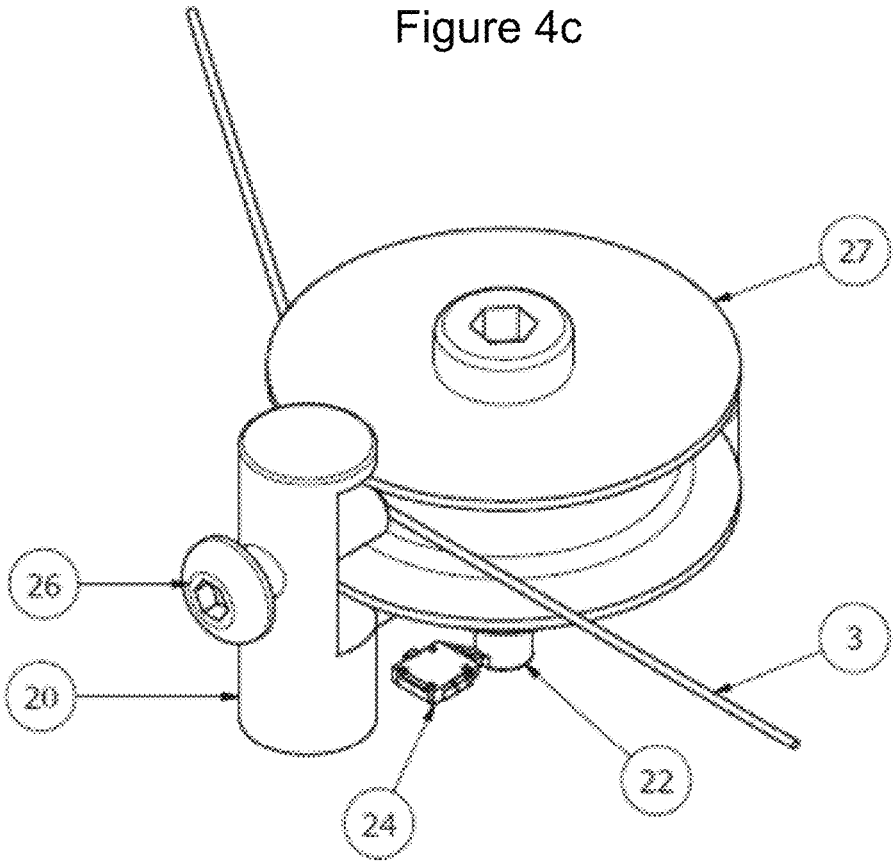

FIGS. 4*c* and 4*d* show, respectively, side and perspective views of the RTC unit 400 in an active (i.e. activated) state, i.e. when the rope 3 is free of any load (i.e. tension) or if the tension experienced by the rope 3 is below a certain predefined threshold.

In the active state of the RTC unit 400, the rope 3 is, in this example, clamped between the flat end screw 26 and the rope guide wheel 27. The switch 24 is activated by the activation pin 22 of the RTC unit 400.

As outlined above, implementations in which the winch comprises an RTC unit 400 provides for various practical advantages. For instance, it may be prevented that the rope 3 will jump out of the rope drum 2 during transportation of the winch (no load or a load below a certain threshold is attached to the winch and the power of the winch is switched off). The rope may hereby be automatically clamped between the flat end screw 26 and the rope guide wheel 27.

A further advantage is that the winch may be prevented from starting to run without a load (object) being attached thereto, such that the rope 3 will not jump out of the rope drum 2.

Further still, if the object (load) touches the ground or another object during movement, the winch can be triggered to stop working, i.e. to raise or lower the object further.

As outlined above, the flat end screw 26 allows for regulating the gap between the flat end screw 26 and the rope guide wheel 27 depending on a diameter or thickness of the rope 3 in a direction generally parallel to the flat end screw 26.

Figure 4E:
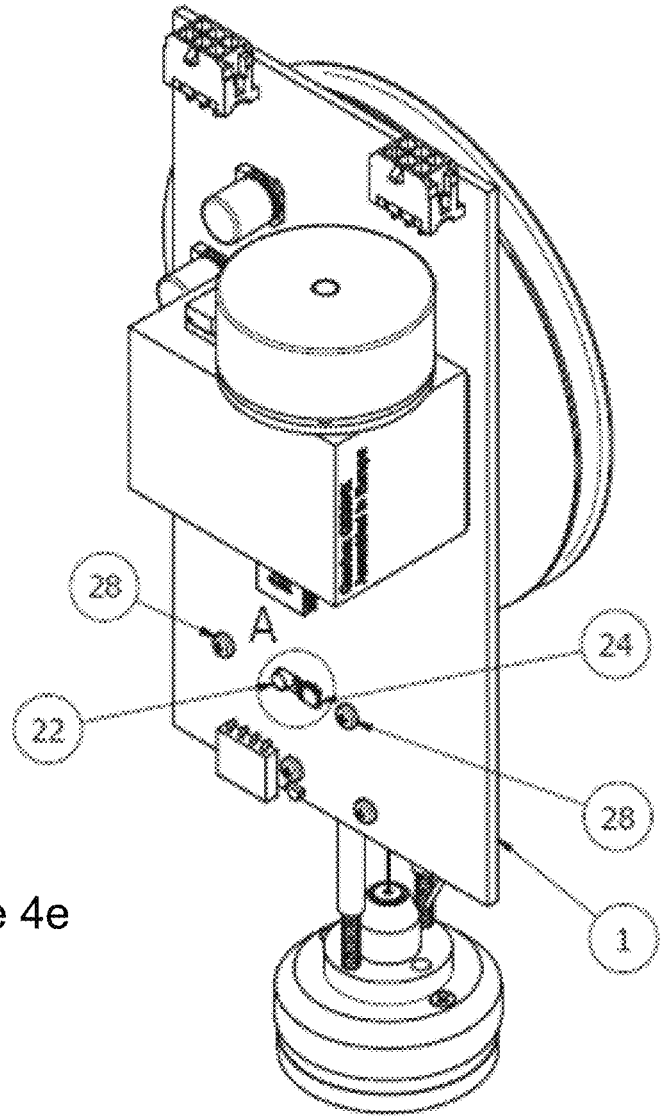
Figure 4F:
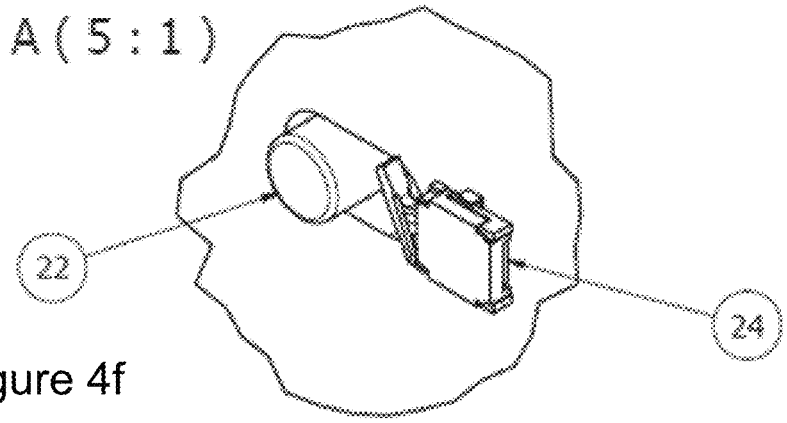

FIG. 4*e* shows a schematic perspective view of how the RTC unit 400 may, according to some example implementations, be arranged on the support frame 1. In this example, the support frame 1 comprises a printed circuit board, which may be particularly suitable for a (relatively) small winch. The RTC unit 400 is mounted on the support frame 1 using multiple mounting screws 28.

Figure 4G:
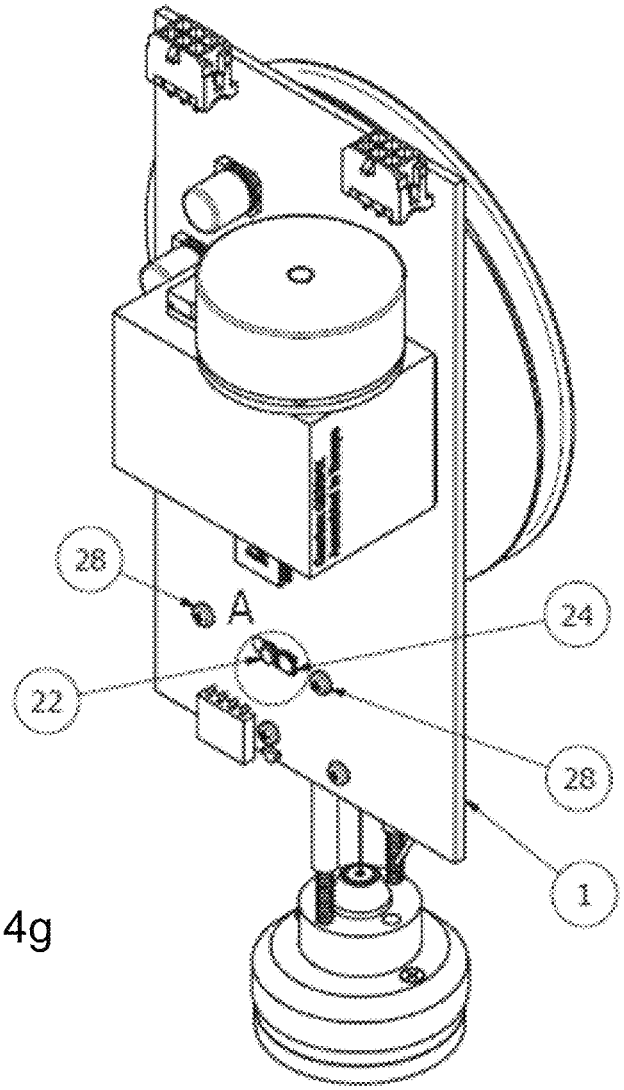

FIG. 4*g* shows a schematic perspective view of the RTC unit 400 in the active state.

Figure 4H:
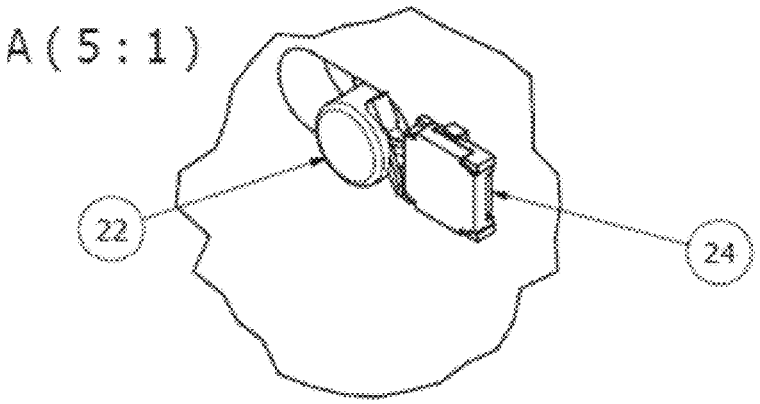

FIG. 4*h* depicts an expanded view of the schematic illustration of the RTC unit 400. In the scenario shown in FIG. 4*h*, the RTC unit 400 is in the activated state, in which no object is attached to the rope 3 (or the tension experienced by the rope 3 is below a certain predefined threshold) and the switch 24 is in the ON state (i.e. the activated state). As can be seen in FIG. 4*h*, the activation pin 22 is in contact with the switch 24.

Figures 5A, 5B:
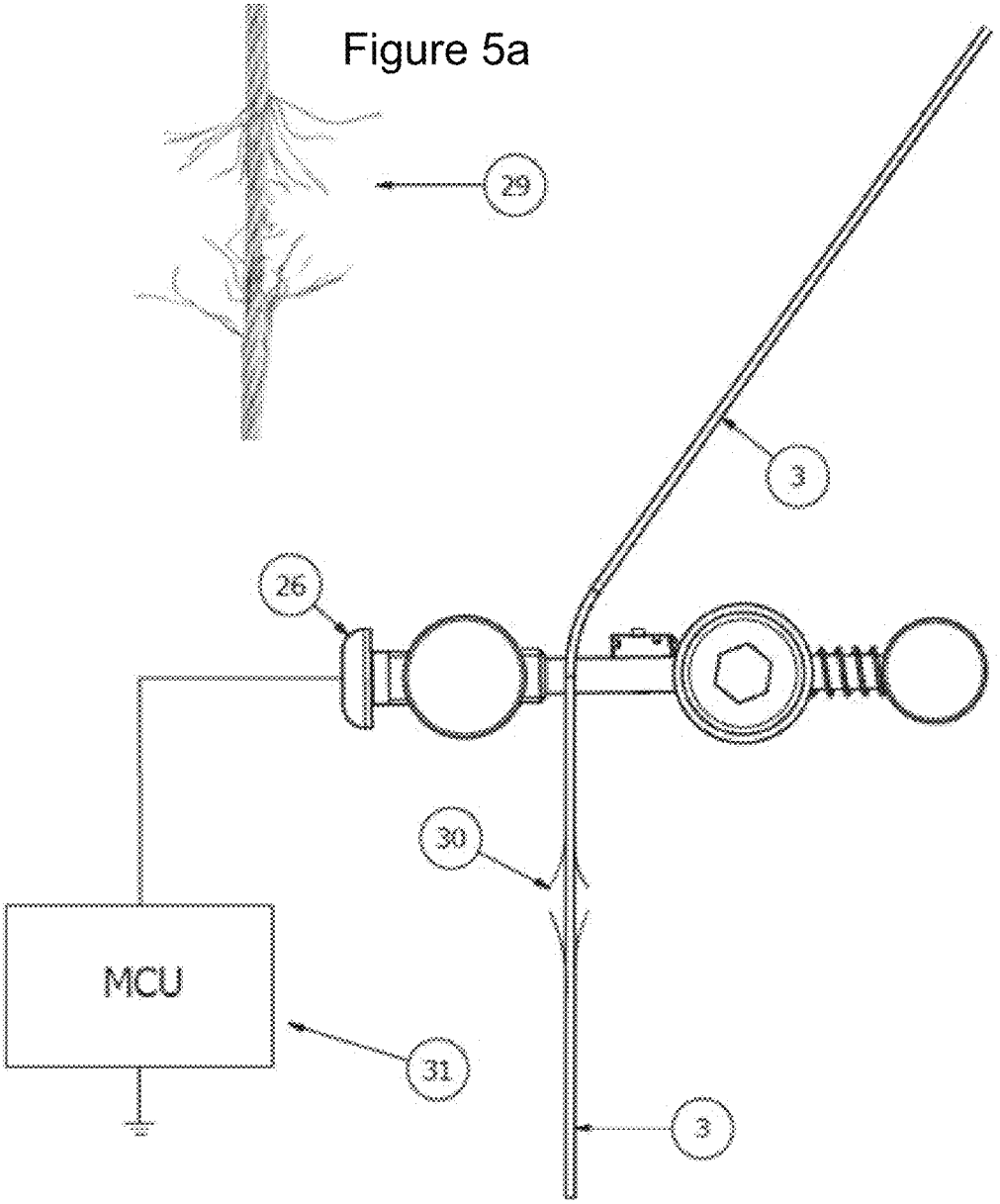
FIGS. 5*a* and 5*b* show schematic illustrations of a partially broken rope and a rope deterioration detection unit, respectively, according to some example implementations as described herein.

FIG. 5*a* shows a rope 3 with broken strands 29, which may be detected according to some example implementations of the RTC unit as described herein.

FIG. 5*b* shows a schematic illustration of a unit 500 which is configured to detect a rope 3 with broken strands 30.

As will be appreciated, the rope 3 may wear over time or may break, as shown in FIG. 5*a*. The RTC unit may be able to determine as to whether the rope 3 comprises such broken strands 30.

In this example, the rope 3 is electrically connected to ground (GND) through the gearbox and the motor. The flat end screw 26 is, in this example, electrically connected to the microcontroller (MCU) 31. When the switch 24 is in the OFF state, the MCU 31 monitors if an electrical contact is established between the flat end screw 26 and the rope broken strands 30. Such an electrical contact may occur during rope up/down movement. If such an electrical contact is detected, the MCU 31 may react accordingly by, for example, stopping the winch from raising or lowering the rope 3 further, and/or indicating to a user of the winch via optical means, such as, but not limited to LEDs, that the rope 3 comprises broken strands 30, and/or sending data to a central controller which may be monitored.

Figure 6A:
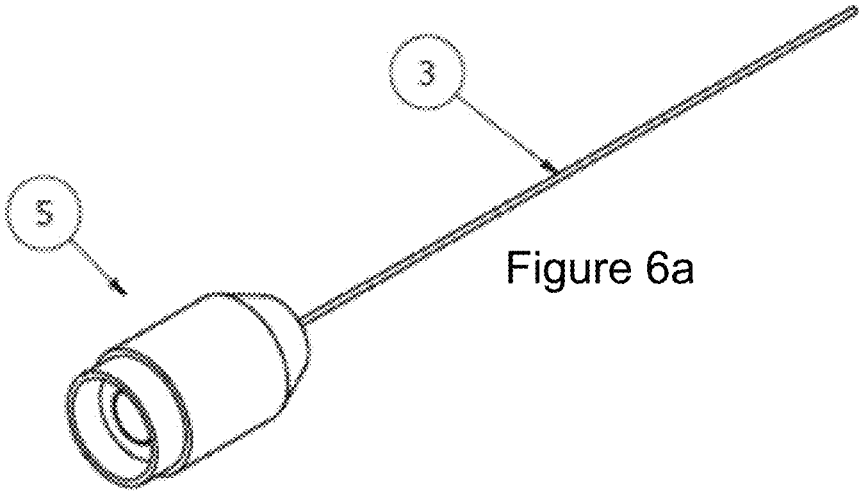
FIGS. 6*a* to 6*c* show schematic illustrations of a load spin prevention device according to some example implementations as described herein.

FIG. 6*a* shows a schematic illustration of a load spin prevention device 5 according to some example implementations as described herein. In this example, the load spin prevention device 5 serves to attach an object (load) to the winch and to prevent the object from spinning around a vertical axis, defined by the rope 3, during movement of the object. This may be particularly advantageous as the rope 3 may twist during roll up/down, which may force the object to rotate with the rope 3. Strands of the rope 3 may be untwisted by varying the rotation speed of winding/unwinding the rope 3 accordingly.

Figure 6B:
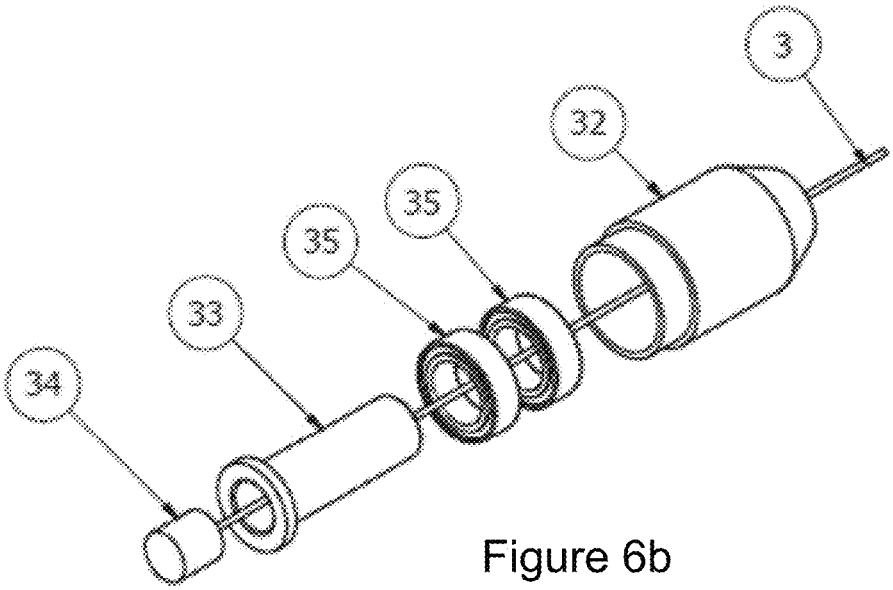

FIG. 6*b* shows a schematic illustration in which the load spin prevention device 5 is dismantled. In this example, the load spin prevention device 5 comprises a lock unit 32 which may be used to attach the object (load). A support member 33 is placed between ball bearings 35 and the rope end ferrule 34 of the load spin prevention device 5. The ball bearings 35 serve to disconnect the object from the rope 3 such that twisting of the object during movement is minimized or entirely prevented.

Figure 6C:
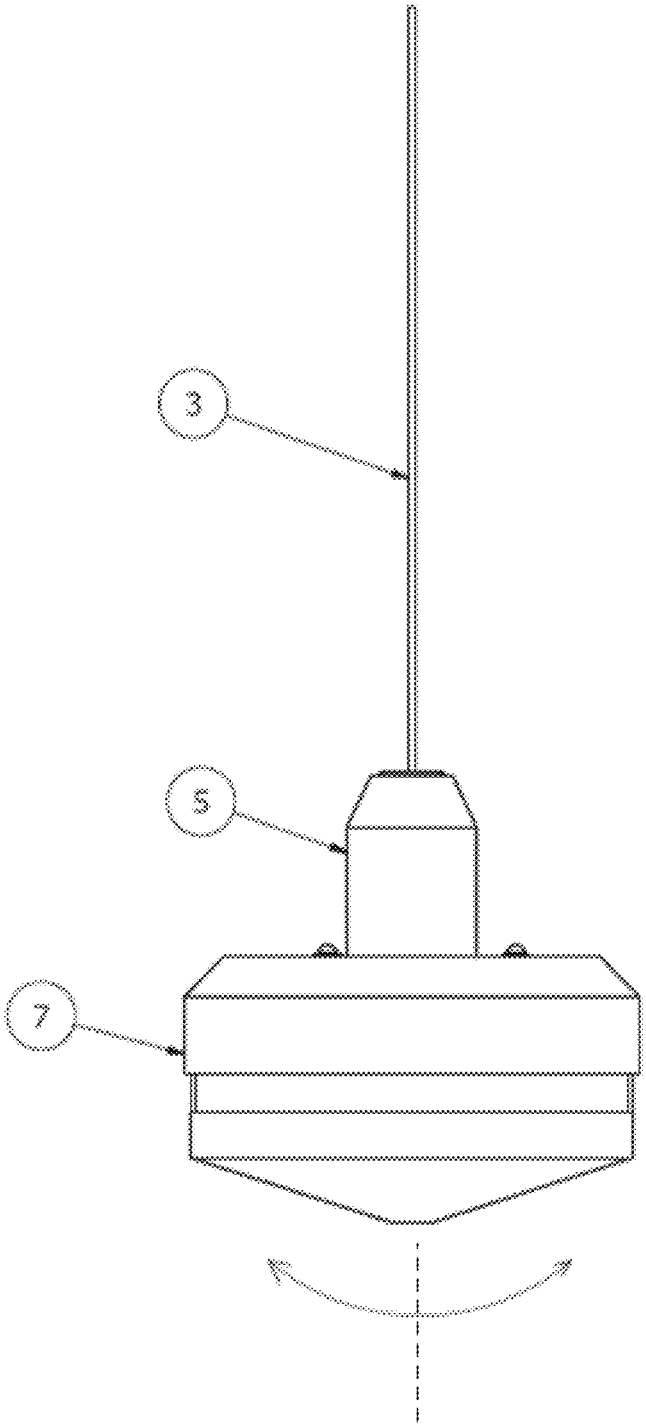
Figure 7A:
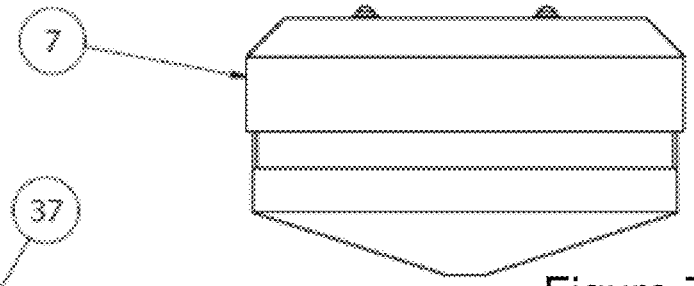
FIGS. 7*a* to 7*d* show various views of an object (load) according to some example implementations as described herein.
Figure 7C:
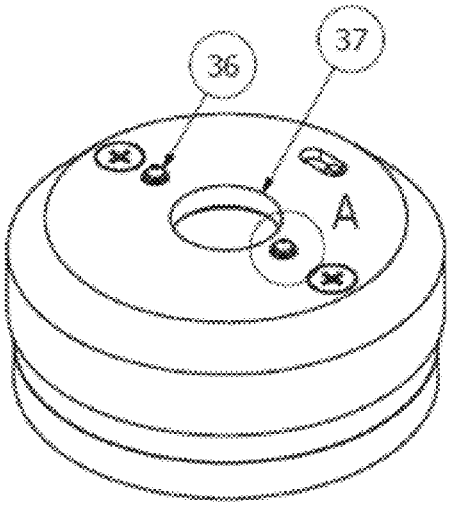
Figure 7B:
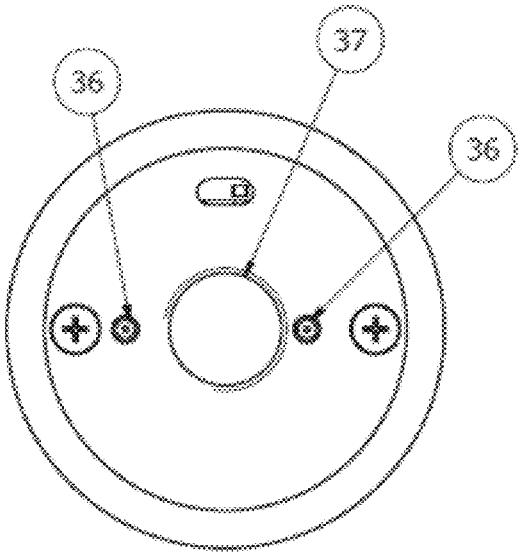
Figure 7D:
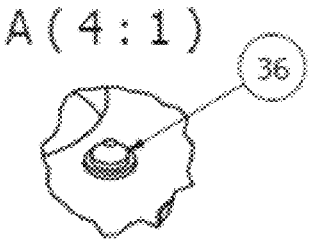

FIG. 6*c* shows a schematic illustration of an object 7 being attached to the load spin prevention device 5. The rotation of the object around the axis as defined by the rope 3 is prevented according to example implementations as described herein.

FIGS. 7*a* to 7*d* show various views of an object 7 according to some example implementations as described herein. In this example, the object 7 comprises electrical contacts 36. The object is, in this example, battery-powered.

The object 7 may be, for example, a microphone, a video camera, a level sensor, or a lighting device. However, it will be appreciated that other objects may be raised or lowered via the winch.

The battery of the object 7 may need to be charged from time to time. Charging of the battery of the object 7 may be performed when the object 7 reaches the OPD unit. Then, the MCU 31 can be used to measure the battery level so that it may be determined as to whether the battery should be charged and/or changed.

The MCU 31 may be used to obtain further information regarding the battery, such as, but not limited to a charging time, a current used to charge the battery, and other parameters. If, for example, the battery is not completely charged, the winch may be prevented from starting to raise or lower the object. Any such instructions may be stored and processed in the MCU 31.

In this example, the object 7 comprises a connecting hole 37 via which the object 7 may be attached to the lock unit 32 of the winch.

Figure 8:
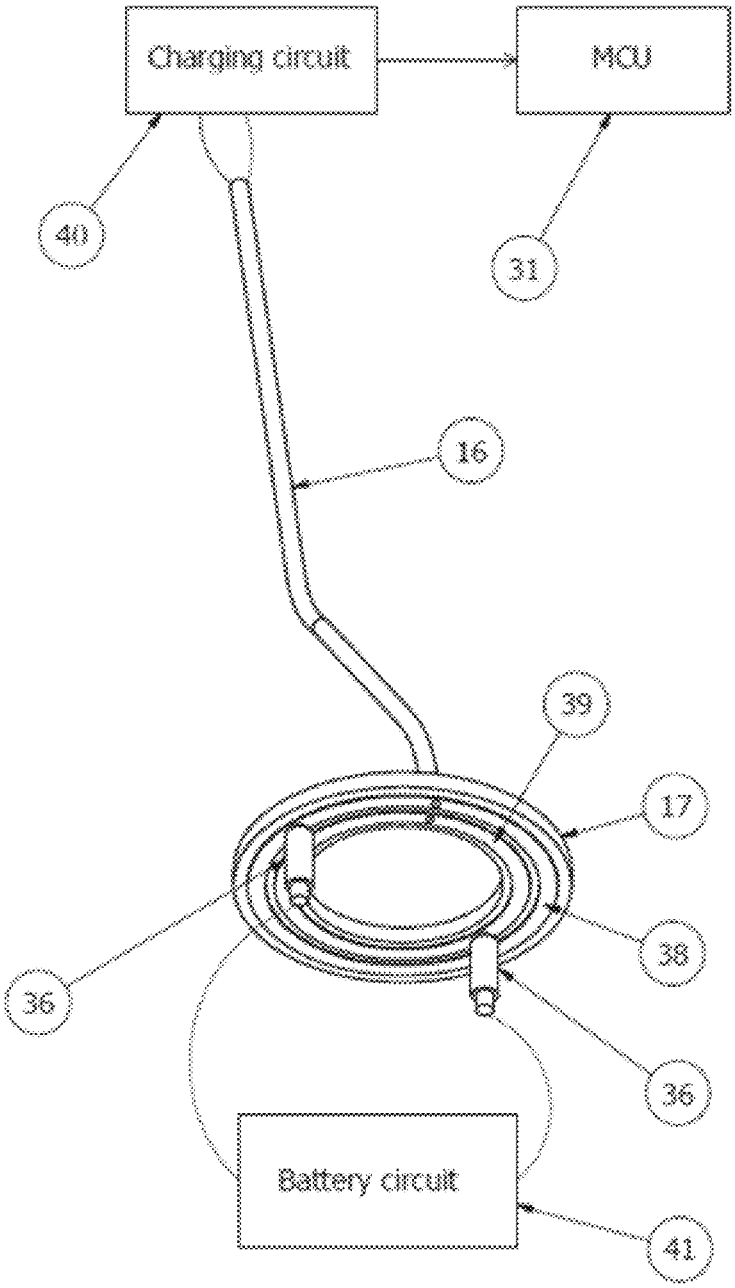
FIG. 8 shows a schematic illustration of parts of a system according to some example implementations as described herein.

FIG. 8 shows a schematic illustration of parts of the system according to some example implementations as described herein. In this example, the object is merely represented by the electrical contacts 36 and the battery circuit 41.

First 38 and second 39 conductors are provided via which the charging circuit 40 may charge the battery of the object. Given the circular arrangement of the power supply board 17 and its electrical contacts and the corresponding arrangement of the electrical parts of the object, the object may be charged irrespective of the rotational orientation of the object with respect to the load spin prevention device. Therefore, even though the object rotational position relative to the power supply board 17 may be unknown, the battery of the object is chargeable.

The power supply board 17 has, in this example, circular contacts 38 and 39 which have different polarities (+ and −). The contacts 36 also relate to different poles (+ and −) and are located on the object in such a manner that a contact on the printed circuit board which provides, for example, a positive voltage will be in contact with the corresponding, respective contact 36 which relates to the positive pole.

In this example, the charging circuit 40 is coupled to the MCU 31, such that the MCU 31 may be used to control charging the battery of the object.

It is to be noted that any references throughout the present disclosure as to an object or load being moved upwards/downwards will equally be applicable to scenarios in which the object or a load is moved (at least partially) in a horizontal direction.

No doubt many other effective alternatives will occur to the skilled person. It will be understood that the invention is not limited to the described embodiments and encompasses modifications apparent to those skilled in the art and lying within the scope of the claims appended hereto.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A winch comprising an overwinding prevention (OP) unit, wherein the OP unit includes:

an OP trigger for triggering preventing a load from being raised further by the winch;

an OP trigger activator (OPTA), moveable between a first OPTA position and a second OPTA position relative to the OP trigger, wherein the OP trigger is in a deactivated state when the OPTA is in the first OPTA position, and wherein the OP trigger is in an activated state, to trigger preventing the bad from being raised further by the winch, when the OPTA is in the second OPTA position, and wherein the OPTA is contactable by the bad such that the OPTA is moveable from the first OPTA position to the second OPTA position upon the bad being raised by the winch; and a rope tension control (RTC) unit for determining a tension experienced by a rope of the winch, wherein the RTC unit includes:

an RTC trigger for triggering preventing the winch from further winding or unwinding the rope; and an RTC trigger activator (RTCTA) moveable between a first RTCTA position and a second RTCTA position relative to the RTC trigger, wherein the RTC trigger is in a deactivated state when the RTCTA is in the first RTCTA position, and wherein the RTC trigger is in an activated state, to trigger preventing the winch from further winding or unwinding the rope, when the RTCTA is in the second RTCTA position, and wherein the RTCTA is configured to move into the second RTCTA position when the tension experienced by the rope falls below a threshold tension.

2. The winch as claimed in claim 1, wherein the OP unit further includes one or more resilient members configured to bias the OPTA towards the first OPTA position.

3. The winch as claimed in claim 1, configured to automatically Tower the load upon activation of the OP trigger.

4. The winch as claimed in claim 1, wherein the RTC unit further comprises a resilient RTC member configured to bias the RTCTA towards the second RTCTA position.

5. The winch as claimed in claim 4, further comprising:

a rope guide wheel for receiving the rope of the winch; and a stop member for clamping the rope between the rope guide wheel and the stop member when the RTCTA is in the second RTCTA position.

6. The winch as claimed in claim 5, wherein the stop member is moveable between different stop member positions, relative to a position of the rope guide wheel, based on a diameter or thickness of the rope.

7. The winch as claimed in claim 1, wherein the RTC trigger is arranged on a printed circuit board comprised in a support frame for supporting the RTC unit.

8. The winch as claimed in claim 1, wherein the RTC unit further comprises a rope deterioration detection unit configured to detect a deterioration of the rope based on an electrical contact being established between the stop member and the rope when the RTC trigger is in the deactivated state.

9. The winch as claimed in claim 8, wherein the rope deterioration detection unit is further configured to stop the winch from winding or unwinding the rope and/or trigger an alarm upon detection of the electrical contact being established between the stop member and the rope when the RTC trigger is in the deactivated state.

10. The winch as claimed in claim 1, comprising a load spin prevention device configured to decouple the load to be raised by the winch from the rope of the winch.

11. The winch as claimed in claim 1, comprising an annular body which comprises a power supply board, wherein the power supply board comprises substantially circular electrical contacts contactable by the load and configured to supply an electrical voltage to the load.

12. The winch as claimed in claim 2, further comprising an annular body which includes a power supply board, wherein the power supply board comprises substantially circular electrical contacts contactable by the load and configured to supply an electrical voltage to the load, wherein the one or more resilient members are configured to stabilize the annular body upon the load being raised or lowered by the winch.

13. The winch as claimed in claim 11, further comprising a charging unit configured to charge a battery of the load via the circular electrical contacts.

14. A system comprising:

the winch of claim 1, wherein the winch comprises (i) an annular body which comprises a power supply board, wherein the power supply board comprises substantially circular electrical contacts contactable by the load and configured to supply an electrical voltage to the load, and (ii) a load holder; and a load attached to the load holder, wherein the load comprises load electrical contacts and a load battery, wherein the system is configured, when the load is in contact with the OP unit, to charge the load battery based on the load electrical contacts being brought into contact with the substantially circular electrical contacts of the power supply board.

* * * * *